United States Patent [19]

Budzich

[11] 4,368,008

[45] Jan. 11, 1983

[54] RECIPROCATING CONTROLS OF A GAS COMPRESSOR USING FREE FLOATING HYDRAULICALLY DRIVEN PISTON

[76] Inventor: Tadeusz Budzich, 80 Murwood Dr., Moreland Hills, Ohio 44022

[21] Appl. No.: 233,218

[22] Filed: Feb. 10, 1981

[51] Int. Cl.[3] ..... F04B 49/00; F04B 3/00; F04B 17/00

[52] U.S. Cl. ..... 417/46; 417/267; 417/397

[58] Field of Search ..... 417/46, 245, 246, 252, 417/267, 286, 317, 397, 403, 404; 91/305, 306

[56] References Cited

U.S. PATENT DOCUMENTS

| | | | |
|---|---|---|---|
| 3,707,881 | 1/1973 | Neuhaus et al. | 91/306 |
| 3,776,665 | 12/1973 | Dalton | 417/252 |
| 4,029,440 | 6/1977 | Olsen | 417/403 |
| 4,213,298 | 7/1980 | Milgram | 417/404 |

*Primary Examiner*—John J. Camby

[57] ABSTRACT

A double acting hydraulically driven gas compressor using a free floating piston the reciprocating action of which is being controlled by a valve system responsive to pressure peaks, generated in hydraulic system on piston reversal, the pressure level of those peaks being higher by a constant pressure differential than the discharge pressure of the gas compressor.

10 Claims, 12 Drawing Figures

RECIPROCATING CONTROLS OF A GAS COMPRESSOR USING FREE FLOATING HYDRAULICALLY DRIVEN PISTON

BACKGROUND OF THE INVENTION

This invention relates generally to reciprocating control of double acting multistage hydraulically driven gas compressors using a free floating piston.

In more particular aspects this invention relates to reciprocating control of a double acting hydraulically driven gas compressor using a free floating piston, which responds to pressure peaks generated in the hydraulic system by stopping of the free floating piston at the end of the compression stroke, providing a compressing mechanism with minimum clearance volume.

In still more particular aspects this invention relates to relief valve mechanism limiting pressure peaks, due to reversal of the free floating piston, to a pressure, higher by a constant pressure differential than the discharge pressure of the gas compressor.

Control of reciprocating hydraulically driven free floating compressor piston presents a difficult problem. Deceleration and stopping of the piston before the end of its stroke provides a large clearance volume, which drastically reduces the displacement of the compressor. Stopping of the free floating piston against the cover, very beneficial from the clearance volume standpoint, also introduces high pressure peaks in the hydraulic system.

SUMMARY OF THE INVENTION

It is therefore a principal object of this invention to provide a reciprocating control of a hydraulically driven free floating piston of a gas compressor, which would provide a compressing mechanism with a minimum clearance volume.

It is a further object of this invention to provide a reciprocating control of a hydraulically driven free floating piston of a gas compressor responsive to pressure peaks in hydraulic system, generated by stopping of the free floating piston.

It is a further object of this invention to provide a reciprocating control of a hydraulically driven free floating piston of a gas compressor, which would limit the pressure peaks, due to reversal of the free floating piston, to a pressure, higher by a constant pressure differential than the discharge pressure of the gas compressor.

Briefly the foregoing and other objects and advantages of this invention are accomplished by providing hydraulically driven reciprocating mechanism of a free floating piston of a gas compressor with a minimum clearance volume, while limiting the pressure peaks due to reversal of the free floating piston to a pressure, higher by a constant pressure differential than the discharge pressure of the gas compressor.

Additional objects of this invention will become apparent when referring to the preferred embodiment of the invention as shown in the accompanying drawings and described in the following description.

DESCRIPTION OF THE PREFERRED EMBODIMENT

Figure 1:
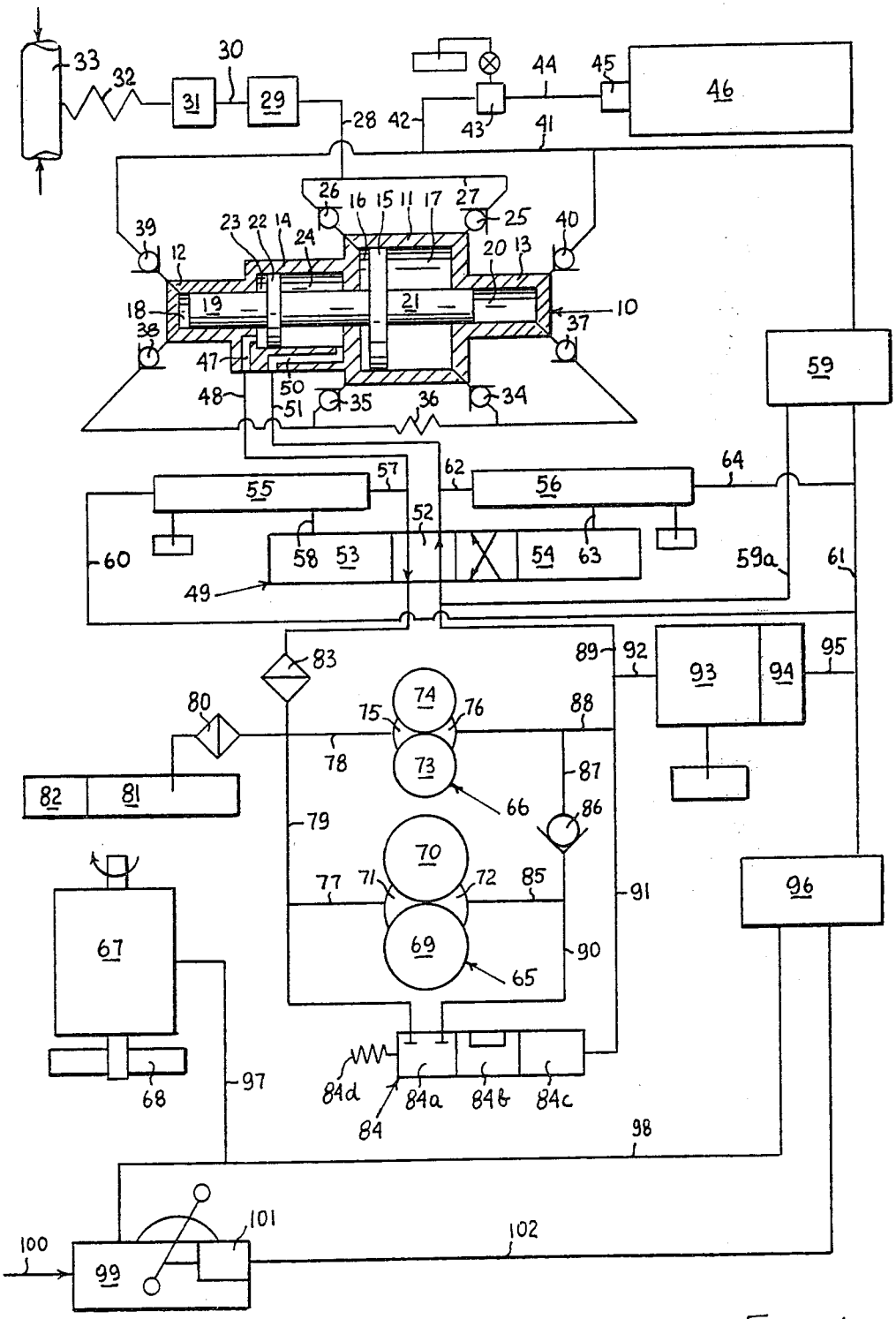
FIG. 1 is a diagrammatic representation of a system and its controls using hydraulically driven gas compressor with system hydraulic power unit being composed of two fixed displacement pumps sequentially activated during compression cycle.

Referring now to FIG. 1, a hydraulically driven two stage gas fuel compressor, generally designated as 10, comprises a low pressure gas stage 11, high pressure gas stages 12 and 13 and a hydraulic power stage 14. A piston 15 divides the low pressure gas stage 11 into first and second compression chambers 16 and 17. The high pressure gas stage 12 is provided with high pressure compression chamber 18 guiding piston 19. High pressure gas stage 13 is provided with high pressure compression chamber 20 guiding piston 21. A piston 22 divides the hydraulic power stage 14 into first and second power chambers 23 and 24. The first and second compression chambers 16 and 17 of the low pressure gas stage 11 are connected by suction check valves 25 and 26, lines 27 and 28, gas flow control valve 29, line 30, gas meter 31 and supply line 32 with the main gas line 33. The first and second compression chambers 16 and 17 of the low pressure gas stage 11, are also connected with exhaust check valves 34 and 35 to a schematically shown intercooler 36, which in turn is connected by high pressure suction check valves 37 and 38 to the high pressure compression chambers 18 and 20. The high pressure compression chambers 18 and 20 are in turn connected through high pressure check valves 39 and 40 and through discharge lines 41 and 42, oil and water separation stage 43, line 44 and a coupling 45 to the pressure vessel 46. The first power chamber 23 is connected through port 47 and line 48 with a four way valve assembly, generally designated as 49. The second power chamber 24 is connected through port 50 and line 51 with the four way valve assembly 49. The four way assembly 49 is provided with a four way valve section 52 and valve actuators 53 and 54, operated by signal generators 55 and 56, which will be described when referring to FIGS. 5 and 7. The signal generator 55 is connected to line 48 by line 57, to valve actuator 53 by line 58 and to gas to oil signal translating device 59, which will be described when referring to FIG. 6, by lines 60 and 61. The signal generator 56 is connected to line 51 by line 62, to valve actuator 54 by line 63 and to gas to oil signal translating device 59 by lines 64 and 61.

The hydraulic power section supplying hydraulic power to operate the gas fuel compressor 10 is composed of a low pressure gear pump, generally designated as 65 and a high pressure gear pump, generally designated as 66, suitably connected into a hydraulic power circuit and driven, in a well known manner, by an electric motor 67, provided with a flywheel 68. The low pressure gear pump 65 is composed of gears 69 and 70, inlet port 71 and outlet port 72. The high pressure gear pump 66 is composed of gears 73 and 74, inlet port 75 and outlet port 76. The inlet ports 71 and 75 are connected by lines 77 and 78 to suction line 79. Suction line 79 is connected through suction filter 80 with the system reservoir 81, which might be pressurized by an exhaust pressurizing stage 82. Suction line 79 is also connected by outlet filter 83 to the four way valve section 52 and to the unloading valve 84, which is provided with a cut-off section 84*a*, a connecting section 84*b* and an actuator section 84*c*, opposed by diagrammatically shown spring 84*d*. Outlet port 72 of the low pressure gear pump 65 is connected through line 85, check valve 86 and lines 87 and 88 to the discharge line 89, connected to the four way valve section 52. Outlet port 72 is also connected by line 90 to the unloading valve 84. Discharge port 76, of the high pressure gear pump 66, is connected by line 88 with the discharge line 89. Discharge line 89 is connected by line 91 to the unloading valve 84 and by line 92 to a relief valve 93, provided with a pressure limiting stage 94, which will be described in detail when referring to FIG. 5, connected by line 95 to line 61 leading to the signal translating device 59. The signal translating device 59 is also connected by line 59*a* to discharge line 89. Line 61, transmitting a hydraulic pressure signal equal to the gas pressure in the pressure vessel 46, is also connected to pressure switch 96. Electrical lines 97 and 98 connect the pressure switch 96 and the electric motor 67 to a switch box 99, connected to an electrical network by line 100. The switch box 99 is provided with a tripping mechanism 101 connected by electric line 102 to the pressure switch 96.

Figure 2:
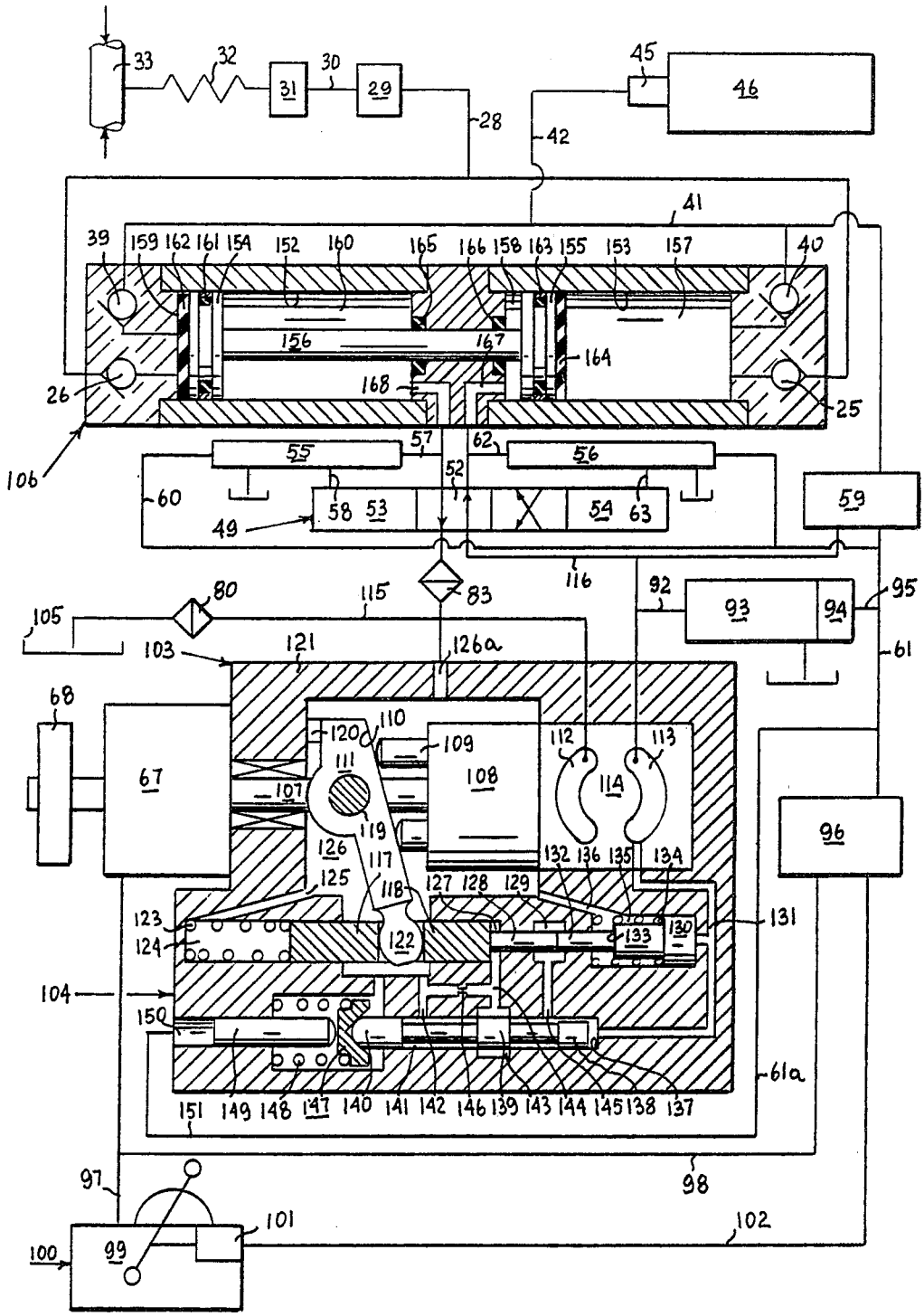
FIG. 2 is a diagrammatic representation of a sytem and its control using hydraulically driven gas compressor with a variable displacement system pump and its controls being shown in a sectional view.
Figure 6:
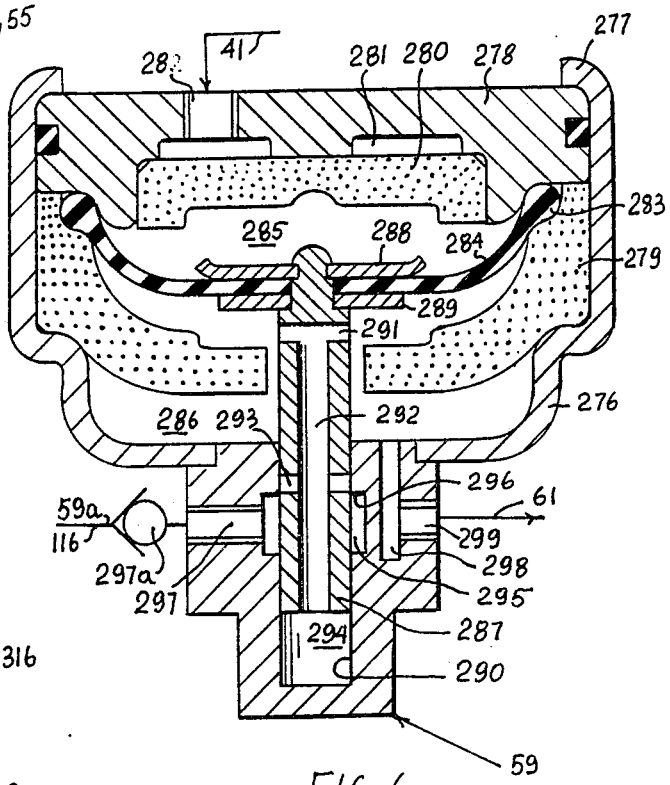
FIG. 6 is a longitudinal sectional view of an embodiment of a gas to oil pressure translating device schematically shown in FIGS. 1 and 2.

Referring now to FIG. 2, the same circuit components used in FIG. 1 are designated by the same numerals. A variable displacement pump, generally designated as 103, with its control section, generally designated as 104, is interposed between a reservoir 105 and a gas fuel compressor, generally designated as 106. The variable displacement pump 103 may be of an axial piston type as shown in FIG. 2, or radial piston type, or vane type, or any other type, in which the volume of fluid output of one revolution of the pump can be regulated. The variable displacement pump 103 is driven by the electric motor 67, provided with the flywheel 68, through a shaft 107, revolving a cylinder barrel 108, slidably guiding pistons 109, which abut against inclined surface 110 of a swash plate 111. Rotation of the cylinder barrel 108 will induce a reciprocating motion in pistons 109, maintained against inclined surface 110, which will result in a fluid transfer from low pressure port 112 to high pressure port 113, of a diagrammatically shown valve plate 114. Low pressure port 112 is connected through suction line 115 and the suction filter 80 with the system reservoir 105. High pressure port 113 is connected through discharge line 116 with the four way valve section 52. The swash plate 111, of the variable displacement pump 103, is subjected to forces of a first actuating piston 117 and a second actuating piston 118 and pivots around a pin 119, regulating the output of high pressure fluid from the pump by change in the angle of inclination of the swash plate 111, in respect to the axis of rotation of the cylinder barrel 108. With a stop 120 engaging surface of a housing 121 the swash plate 111 assumes its maximum angular inclination, corresponding to maximum pump discharge flow. The first actuating piston 117, engaging a spherical extension 122 of the swash plate 111, is subjected to the biasing force of a spring 123 and atomspheric pressure in space 124, which is connected by passage 125 with space 126, contained within the housing 121. Space 126 in turn is connected through port 126*a* with suction line 115 and the reservoir 105. The second actuating piston 118 is subjected to pressure in control space 127, force transmitted by a first control piston 128, due to pressure in a chamber 129 and force transmitted by a second control piston 130, subjected through passage 131 to the pressure in high pressure port 113. The second control piston 130, with its extension 132, engages the first control piston 128 and is provided with a stop 133. The second control piston 130 is biased by a spring 134, contained in space 135, maintained at atmospheric pressure by passage 136 communicating with space 126. The control section 104 of the variable pump 103, is provided with bore 137, axially guiding a pilot valve spool 138. The pilot valve spool 138, shown in FIG. 2 in a modulating position, has a metering land 139 and a land 140, defining annular space 141, which is connected by passage 142 with space 126, maintained at atmospheric pressure. Bore 137 is provided with annular space 143, connected by passage 144 with control space 127. The chamber 129 is connected by passage 145 with a portion of the bore 137, which in turn is connected by passage 131 with high pressure port 113. Leakage orifice 146 connects for fluid flow passages 144 and 142, therefore, effectively cross-connecting control space 127 with space 126 and the system reservoir 105. The pilot valve spool 138, through the spherical end of the land 140 and a spring guide 147, is subjected to the biasing force of a control spring 148. The pilot valve spool 138 is also subjected to the force developed by a third control piston 149, which abuts the spring guide 147 and is subjected to pressure in space 150. The space 150 is connected by lines 151 and 61 to the control signal translating device 59, which transmits a hydraulic pressure signal, equal to the gas fuel pressure contained in the pressure vessel 46. The construction of the translating device 59 is shown in FIG. 6 and will be described in detail later in the text.

The gas fuel compressor 106 is provided with bores 152 and 153, slidably engaging pistons 154 and 155 connected by a piston rod 156. The piston 155 divides the space, contained within bore 153 into first compression chamber 157 and first hydraulic power chamber 158. The piston 154 divides the space contained within bore 152 into second compression chamber 159 and second hydraulic power chamber 160. With position of piston 154 as shown in FIG. 2, the volume of the second compression chamber 159 is zero, the piston 154 being at the end of the compression stroke, at a point of reversal of direction of its motion. The piston 154 is provided with a suitable seal assembly 161 and a shock absorber 162. The piston 155 is provided with a suitable seal assembly 163 and a shock absorber 164. The piston rod 156 is suitably sealed by seals 165 and 166. First and second compression chambers 157 and 159 are connected through suction check valves 25 and 26, lines 27 and 28, the gas flow control valve 29, line 30, the gas meter 31, and supply line 32 to main gas line 33. First and second compression chambers 157 and 159 are also connected through discharge check valves 39 and 40, lines 41 and 42 and the coupling 45 to the pressure vessel 46. The first hydraulic power chamber 158 is connected by port 167 to the four way valve section 52. The second hydraulic power chamber 160 is also connected by port 168 to the four way valve section 52. The four way valve assembly 49 including the four way valve section 52, valve actuators 53 and 54 and signal generators 55 and 56 is identical to that shown in FIG. 1 and will be described fully later in the text when referring to FIG. 5.

Figure 3:
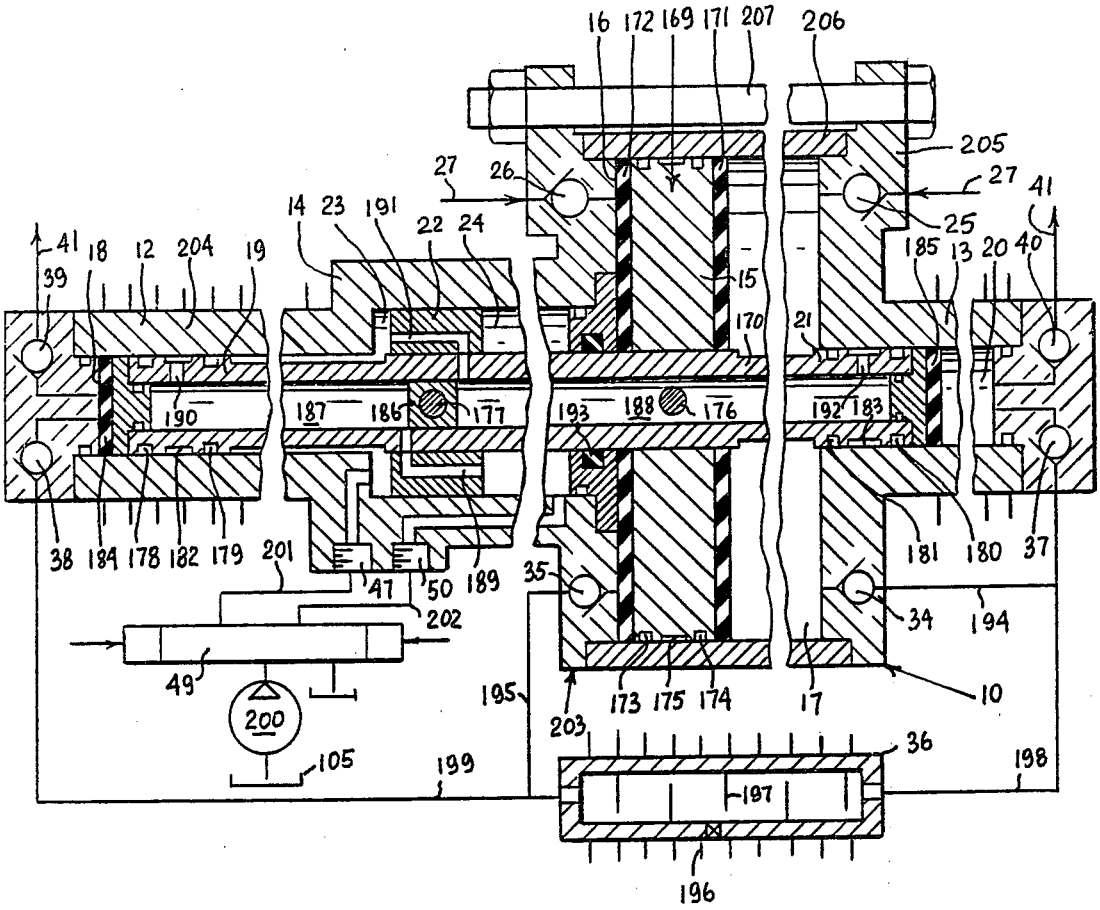
FIG. 3 is a longtidunal sectional view of an embodiment of a hydraulically driven two stage double acting gas compressor.

Referring now to FIG. 3, the same components used in FIGS. 1 and 2 are designated by the same numerals. FIG. 3 shows the gas fuel compressor 10 of FIG. 1 in more detail. The gas fuel compressor of FIG. 3 is broken into five sections to demonstrate that it is characterized by a large stroke to diameter ratio. The piston assembly, generally deignated as 169, of the gas fuel compressor 10 is shown fully displaced to the left with the volume of the high pressure compression chamber 18 and the first compression chamber 16 becoming very small. The piston assembly 169 is composed of a piston rod 170, both ends of which form the high pressure pistons 19 and 21, the low pressure piston 15 and the hydraulic power piston 22. The low pressure piston 15, provided with shock absorbers 171 and 172, seal rings 173 and 174 and a bearing 175, is suitably fastened to the piston rod 170 by a pin 176. The hydraulic power piston 22 is fastened to the piston rod 170 by a pin 177. High pressure pistons 19 and 21 are provided with sealing rings 178, 179, 180 and 181 and bearings 182 and 183 and are also provided with shock absorbers 184 and 185. Hollow space inside the piston rod 170 is divided by a partition 186, secured by a pin 177, into spaces 187 and 188. Space 187 connects through passage 189 the second power chamber 24, with passage 190 leading to the bearing 182. Space 188 connects through passage 191 the first power chamber 23, with passage 192 leading to the bearing 183. The first compression chamber 16 and the second power chamber 24 are suitably sealed by seal 193. The gas fuel is supplied to first and second compression chambers 16 and 17 from the gas fuel distribution system through suction check valves 26 and 27. The first and second compression chambers 16 and 17 are also connected by check valves 34 and 35 and lines 194 and 195 to the intercooler 36, which might be provided with cooling fins 196 and labyrinth fins 197. The intercooler 36 is connected by lines 198 and 199 to the check valves 37 and 38, communicating with high pressure compression chambers 18 and 20. High pressure compression chambers 18 and 20 are also connected through discharge check valves 39 and 40 to discharge line 41, leading to the pressure vessel, not shown. A pump 200 supplies pressure oil to the four way valve assembly 49, which is connected through line 201 with port 47, leading to first power chamber 23 and through line 202 with port 50, leading to second power chamber 24, while also being connected to the reservoir 105. A housing, generally designated as 203, is composed of section 204 provided for high pressure gas stage 12 and hydraulic power stage 14, section 205 provided for high pressure gas stage 13 and tubular section 206 provided for low pressure gas stage. The tubular section 206 radially locates the sections 204 and 205, the bolts 207 securing together the housing 203.

Figure 4:
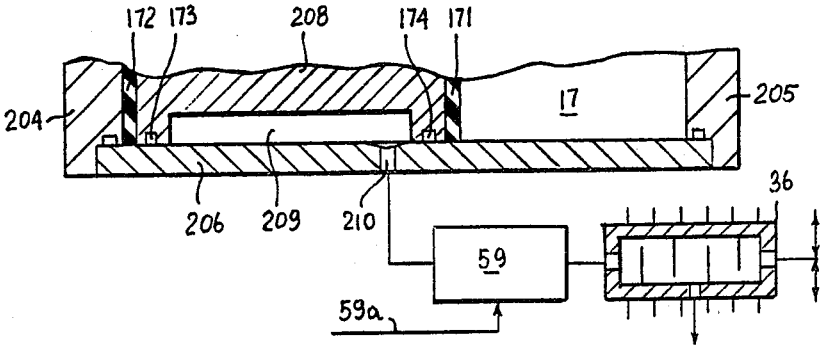
FIG. 4 is a partial longitudinal sectional view showing detail of a modified piston and cylinder of the first compression stage of FIG. 3.

Referring now to FIG. 4, the tubular section 206 is elongated and so is a low pressure piston 208, which is provided with groove 209. Groove 209 is supplied through port 210 with oil at pressure in intercooler 36, by the translating device 59, connected by line 59*a* to the discharge port of the system pump. In this way the pressurized oil in groove 209 provides effective sealing and lubrication for seal rings 173 and 174.

Figure 5:
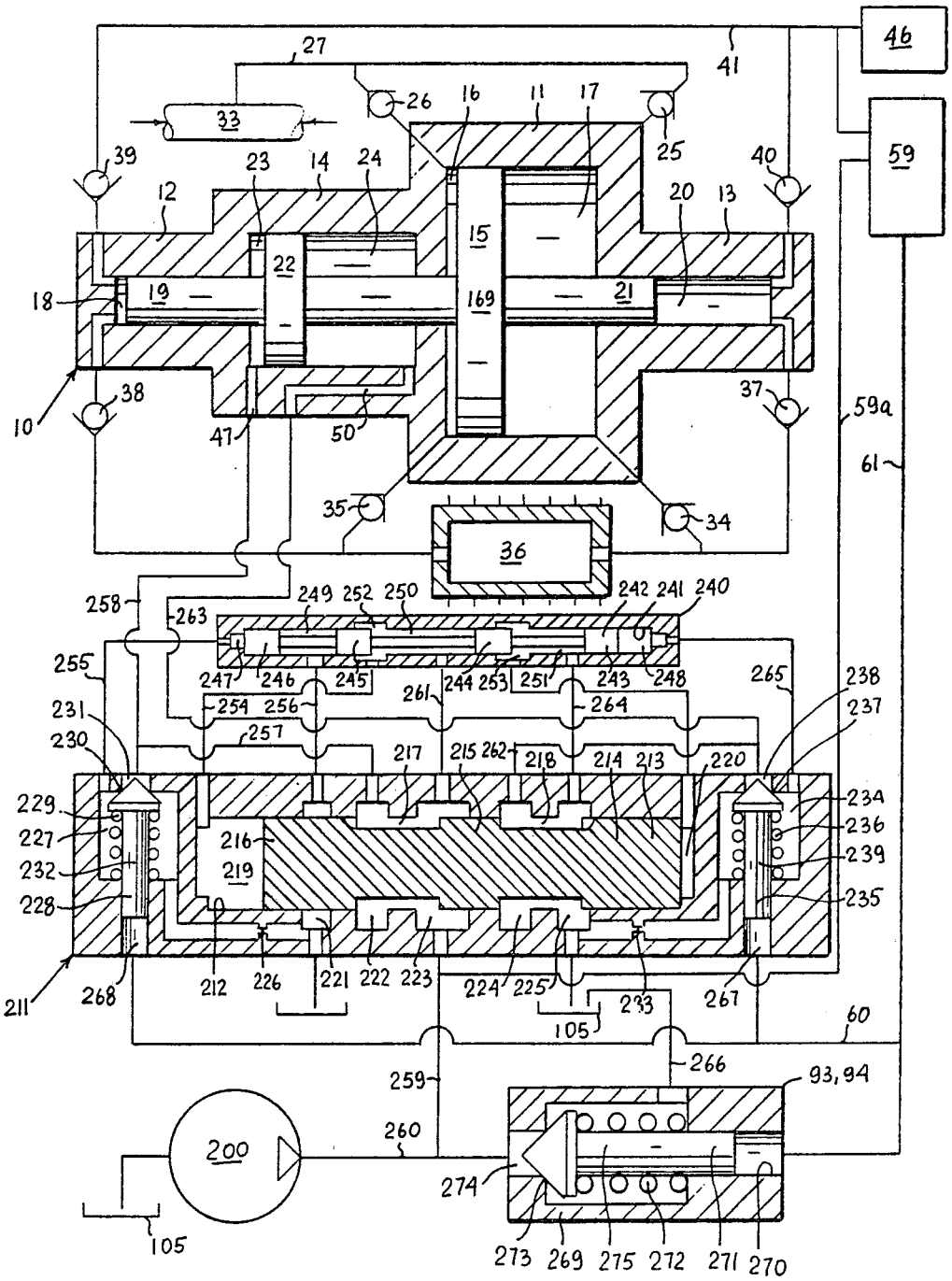
FIG. 5 is a longitudinal sectional view of an embodiment of reciprocating controls of hydraulically driven gas compressor with system pump and pressure vessel shown schematically.

Referring now to FIG. 5, the same components used in FIGS. 1, 2 and 3 are designated by the same numerals. FIG. 5 shows schematically the gas fuel compressor 10 of FIGS. 1 and 3, integrated into a control system with the reciprocating motion control regulated by a control valve, generally designated as 211, which is shown schematically in FIGS. 1, 2 and 3. FIG. 5 also shows the detail of the relief valve 93 with its pressure limiting stage 94, schematically shown in FIGS. 1, 2 and 3. The control valve 211 is provided with bore 212, slidably guiding in sealing engagement control spool 213, which is provided with lands 214, 215 and 216 and annular grooves 217 and 218. The control spool 213 divides the space, contained by the bore 212, into a first chamber 219 and a second chamber 220. Bore 212 is provided with first annular space 221, second annular space 222, third annular space 223, fourth annular space 224 and fifth annular space 225. First annular space 221 is connected through orifice 226 with an outlet chamber 227, of signal generator poppet 228, which is biased by a spring 229 into engagement with a seat 230 of port 231, which may be selected of the same diameter as a stem 232 of the signal generator poppet 228. Fifth annular space 225 is connected through orifice 233 with an outlet chamber 234 of signal generator poppet 235, which is biased by a spring 236 into engagement with a seat 237 of port 238, which may be selected of the same diameter as a stem 239 of the signal generator poppet 235. A shuttle valve is provided with a bore 241 guiding in sealing engagement a shuttle spool 242 with its lands 243, 244, 245 and 246 defining chambers 247 and 248 and annular spaces 249, 250 and 251. Bore 241 is provided with annular chambers 252 and 253. The first chamber 219 is connected by line 254 with the annular chamber 252. The outlet chamber 227 is connected by line 255 with the chamber 247. First annular space 221 is connected to the reservoir 105 and also connected by line 256 to annular space 249. Second annular space 222 is connected by line 257 to line 258, which in turn is connected to port 231 and port 47 leading to the first power chamber 23. Third annular space 223 is connected by lines 259 and 260 to the system pump 200 and is also connected by line 261 with annular space 250. Fourth annular space 224 is connected by lines 262 and 263 with port 238 and port 50, leading to the second power chamber 24. Fifth annular space 225, connected to the reservoir 105, is also connected by line 264 to annular space 251. The outlet chamber 234 is connected by line 265 with the chamber 248. Line 260 also connects the system pump 200 and annular space 223 with the relief valve 93, provided with a pressure limiting stage 94, which in turn is connected by line 266 with the system reservoir 105 and with the line 61 to the signal translating device 59. Ports 267 and 268, of signal generating poppets 235 and 228, are also connected by lines 61 and 60 with the signal translating device 59. The system relief valve 93 has a housing 289, provided with bore 290, guiding poppet 271, which is biased by a spring 272 into engagement with seat 273 of port 274, which may be of the same diameter as stem 275 of the poppet 271.

Referring now to FIG. 6, the same circuit components used in FIGS. 1 to 5 are designated by the same numerals. The signal translating device, generally designated as 59, and schematically shown in FIGS. 1, 2 and 5, comprises a fabricated housing 276, a rim 277 of housing 276 being swaged over to secure the assembly of a cover 278 and a diaphragm support 279. The cover 278 is provided with an insert 280, which communicates with annular space 281, connected by port 282 with discharge line 41. The cover 278 and the diaphragm support 279 form a surface anchoring a bead 283 of a diaphragm 284. The diaphragm 284 divides the signal translating device 59 into space 285, containing compressed gas fuel and space 286, containing hydraulic fluid. A spool 287, centrally attached by washers 288 and 289 to the center of the diaphragm 284 and in sealing engagement therewith, is slidably guided in sealing engagement in bore 290, provided in the housing 276. The spool 287 is provided with passages 291, 292 and 293, which connect hydraulic fluid from space 286 to space 294 and annular space 295, provided with a control surface 286. Annular space 295 through port 297 and check valve **297*a* is connected to line 59*a*, which in turn is connected to discharge port of the system pump. The hydraulic fluid from space 286 is also connected by passage 298 and port 299 with line 61, transmitting hydraulic control signal to the components of the sensing circuits of FIGS. 1, 2 and 5**.

Figure 7:
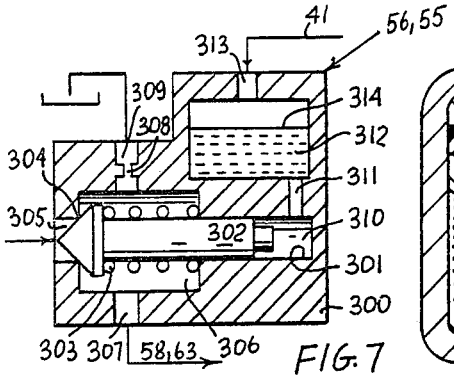
FIG. 7 is a longitudinal sectional view of one embodiment of a signal generating device schematically shown in FIGS. 1 and 2.

Referring now to FIG. 7, a signal generator, generally designated as 56 or 55, see FIGS. 1 and 2, is shown in a simplified form with its own surface of hydraulic fluid. The signal generator 56 is provided with a housing 300 provided with a bore 301, slidably guiding a poppet 302, which is biased by a spring 303 towards engagement with a seat 304 of port 305. The poppet 302 projects into space 306, which is connected by port 307 to lines 58 or 63 and through orifice 308 and port 309 to the system reservoir. Bore 301 and the poppet 302 define control space 310, connected by passage 311 to space 312, which in turn is connected through port 313 to discharge line 41 and therefore to the source of compressed gas fuel. Space 312 is partially filled with hydraulic fluid, which provides a free surface 314.

Figure 8:
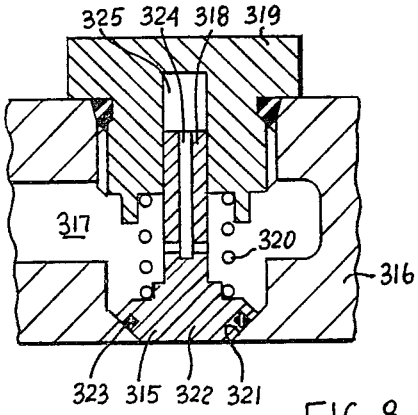
FIG. 8 is a partial longitudinal sectional view of an embodiment of a discharge check valve.

Referring now to FIG. 8, an embodiment of the typical high pressure check valve 39 or 40 of FIGS. 1, 2 and 5 is shown. A poppet 315, in sealing engagement with a housing 316, is interposed between the high pressure compression chamber, containing gas fuel and space 317, connected to discharge line 41. The poppet 315, guided by its stem 318 in bore provided in a plug 319, is biased by a spring 320 towards sealing engagement with surface 321 of the housing 316. A sealing end 322 of the poppet 315 may be provided with a sealing device 323. The stem 318 of the poppet 315 guided in the plug 319, is provided with a passage 324, communicating space 325 with space 317.

Figure 9:
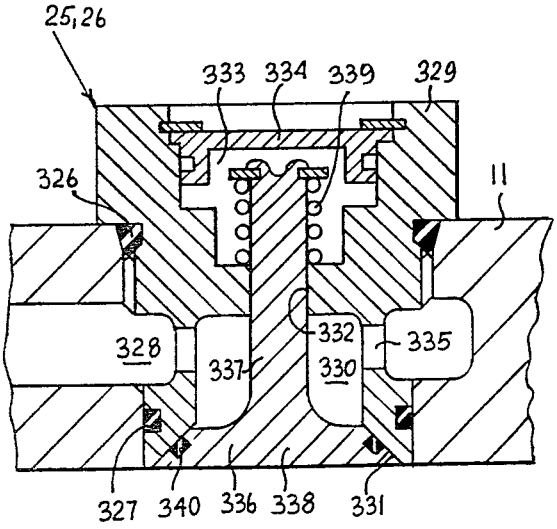
FIG. 9 is a partial longitudinal sectional view of one embodiment of a suction check valve.

Referring now to FIG. 9, an embodiment of a typical suction check valve 25 or 26 of FIGS. 1, 2 and 5 is shown. The suction check valve assembly is threaded into and sutiably sealed by seals 326 and 327, in respect to the low pressure gas stage 11, provided with space 328, which is connected to suction line 28. The suction check valve assembly comprises a housing 329 provided with a chamber 330, sealing surface 331, bore 332 and a chamber 333 suitably sealed by a cap 334. The chamber 330 is connected by passages 335 with space 328. A poppet 336, slidably guided by a stem 337 in bore 332, has a conical section 338 biased, towards sealing engagement with surface 331, by a spring 339, contained in the chamber 333. The conical section 338, of the poppet 336, directly communicates with the gas fuel in the low pressure stage and may contain a sealing member 340.

Figure 10:
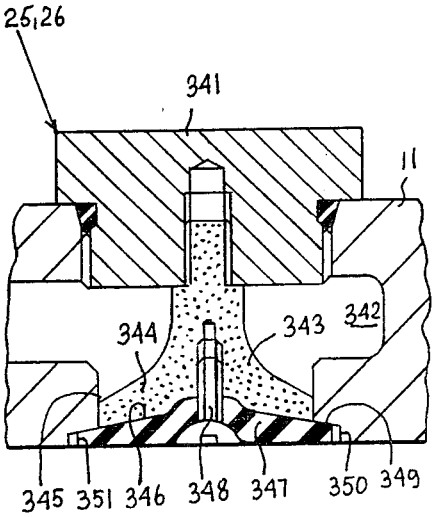
FIG. 10 is a partial longitudinal sectional view of another embodiment of a suction check valve.

Referring now to FIG. 10, another embodiment of a suction check valve 25 or 26 of FIGS. 1, 2 and 5 is shown. A plug 341 is threaded into the low pressure gas stage 11, provided with space 342, which is connected to suction line 28. A porous support member 343 is threaded into the plug 341 and engages with flange section 344 bore 345, provided in the low pressure gas stage 11. The flange section 344 is shaped to provide a support surface 346 for an elastomer flexing member 347, which is secured to the porous support member by a suitable fastener 348. Support surface 346 mates with sealing surface 349, provided in the low pressure gas stage 11. Sealing surface 349 terminates in cylindrical surface 350, which is of larger diameter than the surface 351 of the elastomer flexing member 347.

Figure 11:
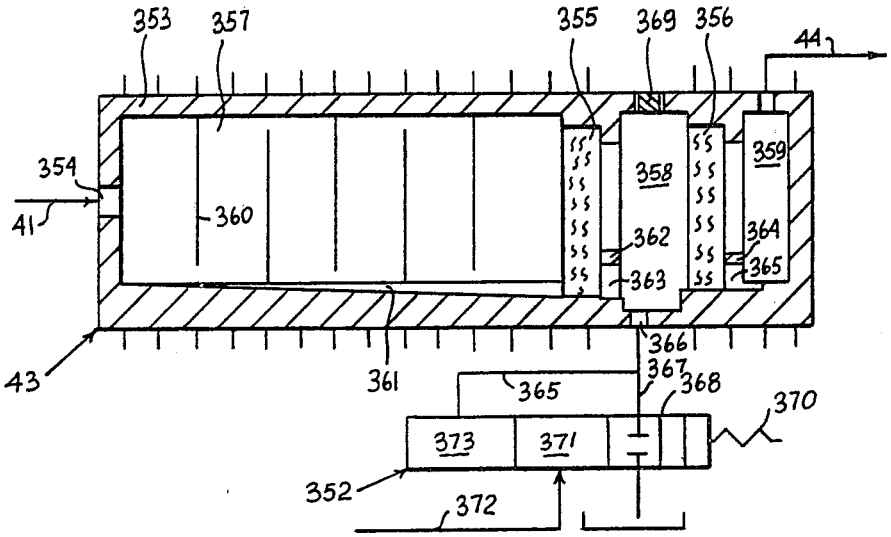
FIG. 11 is a longitudinal sectional view of an embodiment of an aftercooler and oil and water separator with an unloading valve shown diagrammatically.

Referring now to FIG. 11, an oil separation stage, generally designated as 43, schematically illustrated in FIG. 1, is shown connected into the hydraulic fluid circuit by a cut-off valve, generally designated as 352. The oil separation stage 43 comprises a housing 353, provided with port 354 connected to discharge line 41. The housing 353 retains first porous filter element 355 and a second porous filter element 356, which together with the housing 353 define a labyrinth chamber 357, a filter chamber 358 and an outlet chamber 359. The labyrinth chamber 357 may be provided with a number of labyrinth fins 360 and oil flow channel 361. A support 362, of first porous filter element 355, is provided with port 363 opposite oil flow channel 361. A support 364 of second porous filter element 356 is provided with port 364 generally opposite port 363. The filter chamber 358 communicates through port 365 and line 367 with the diagrammatically shown on-off section 368 of the cut-off valve 352. The access to filter chamber 358 is provided through a removable plug 369. The outlet chamber 359 is connected through line 44 leading to the pressure vessel 46, see FIG. 1. The cut-off valve 352 includes on-off section 368, biased by a schematically shown spring 370 towards the "on" position, a solenoid section 371 responsive to a control signal in the form of input current 372 and operable in the presence of the input current to move the on-off section towards "off" position and an actuating section 373 responsive to discharge pressure in the filter chamber 358, transmitted through line 374 and operable, in the presence of discharge pressure higher than the equivalent to the preload of the spring 370, to move the on-off section into "off" position.

Figure 12:
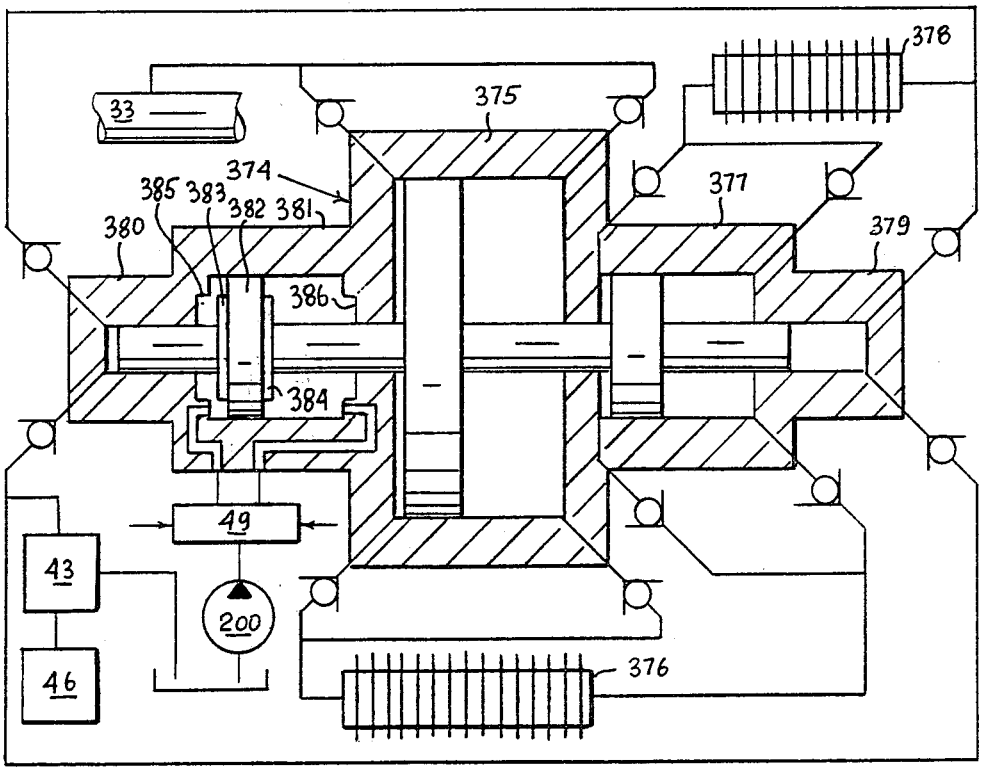
FIG. 12 is a longitudinal sectional view of a hydraulically driven three stage gas compressor with check valves, intercoolers, reciprocating control system, system pump and gas pressure vessel shown schematically.

Referring now to FIG. 12, a hydraulically driven three stage double acting compressor, generally designated as 374 is shown. The compressor 374 comprises first gas compression stage 375 connected with check valves to the main gas line 33 and to a first intercooler 376, second gas compression stage 377 connected with check valves with the first intercooler 376 and a second intercooler 378, third gas compression stages 379 and 380 connected with check valves with the second intercooler 378 and through the water and oil separating stage 43 also connected to the pressure vessel 46 and a hydraulic power stage 381 connected through control valve 49 to the system pump 200. The hydraulic power stage 381 has a piston 382 provided with damping pistons 383 and 384 cooperating with damping cylinders 385 and 386.

Referring now back to FIG. 1, the two stage gas fuel compressor, generally designated as 10, is shown interposed between main gas line 33 and the pressure vessel 46. The gas, which can be methane, is drawn from gas line 33 through the gas meter 31, gas flow control valve 29 and suction check valves 25 and 26 to the low pressure gas stage 11, where it is compressed through the reciprocating motion of piston 15 to an intermediate pressure level and passed through discharge check valves 35 and 34 to schematically shown intercooler 36, well known in the art. In the intercooler 36 the adiabatic heat of compression is dissipated and the gas, at lower temperature and intermediate pressure, is supplied through suction check valves 37 and 38 to high pressure gas stage 12 and 13, where it is compressed by the reciprocating action of pistons 19 and 21 and passed, at high pressure level, through discharge check valves 39 and 40 and a cooling oil and moisture separation stage 43 to the storage pressure vessel 46. The compression cycle and the details of the construction of the gas fuel compressor 10 will be more fully described later in the specification when referring to FIGS. 3, 4 and 12.

The reciprocating motion to the compressor piston assembly is hydraulically transmitted through the integral piston 23, of the hydraulic power stage 14, provided with the first power chamber 23 and the second power chamber 24. The reciprocating motion is induced to the piston 22 by the four way valve assembly, generally designated as 49, which sequentially connects the first and second power chambers 23 and 24 to either pressure oil from the power circuit, including the system pump, or to the system reservoir 81. The sequencing operation of the four way valve 49 may be controlled by a suitable timer, or may be related to the compression cycle of the gas fuel compressor 10, or may be related to the position of the compressor piston assembly. The significance of the signal generators 55 and 56 and gas to hydraulic pressure translating device 59, as related to the sequencing operation of the four way valve 49, will be described in detail when referring to FIG. 5.

The fluid power to drive the gas fuel compressor 10 is generated by two schematically shown fixed displacement gear pumps, generally designated as 65 and 66, integrated by lines and other system components into a suitable hydraulic power circuit. The diameters of pistons of low pressure gas stage 11 and high pressure gas stages 12 and 13 are so selected, that both the low and the high pressure stages have the same compression ratio, when compressing the gas to its maximum pressure. The reason for this selection is to obtain, in low and high gas compression stages, the same maximum gas temperatures, due to heat generated in adiabatic gas compression. The effective area of the piston 22, of the hydraulic power stage 14, will then become a function of the compression ratio, piston diameters of the low and high compressor stages and the maximum pressure developed in the hydraulic power circuit. In a gas compressor, supplied with power at a relatively constant level, the compressing piston velocity must vary inversely with the compression pressure. This is a nonlinear relationship, since the rate of change of volume, during a compression cycle, varies with compression pressure according to the gas law. Therefore, to maintain a constant horsepower input into the compressor and therefore to obtain maximum compressed gas output per unit time out of the compressor, high piston velocity, required during the initial stages of compression, must be gradually reduced. The dual pump arrangement of FIG. 1 approximates this requirement in the following way. The gear pump assemblies, generally designated as 65 and 66, are driven, in a well known manner, at the same speed by the electric motor 67, provided with the flywheel 68.

Assume that the power piston of the compressor 10 is in the initial stages of compression, moving from right to left. Then port 50, of the hydraulic power stage, is connected to the combined output of pumps 65 and 66, while the port 48 is connected to the reservoir 81. The compressor piston will then move, at maximum velocity, until the discharge pressure of the pump, equivalent to a certain compression pressure, will reach a level, at which the power output of the electric motor 67 will reach its full capacity. The spring **84*d* of the unloading valve 84 is set at this pressure level and permits the actuator section 84*c* to move the connecting section 84*b* from right to left, connecting line 90 to suction line 79 and effectively cross-connecting inlet and outlet ports of the gear pump 65. The check valve 86 will seat and the gear pump 66 will alone supply the oil flow to the hydraulic power stage 14. The power output of the electric motor 67 will decrease and the compressing piston will continue to move from right to left, at a reduced velocity, until a compression pressure is reached, at which the discharge check valves 39 and 40 will open. If during charging of the pressure vessel 46 this discharge pressure will approach the maximum rated charge pressure, the electric motor 67 will reach its rated horsepower output. The compressing piston will continue moving from right to left, past the position as shown in FIG. 1, until the end of its stroke is reached. Stopping of the compressor piston will result in a pressure spike, limited by the relief valve 93, which through the signal generators 55 and 56 will move the four way valve 49, connecting port 47 of the hydraulic power stage 14, with the system pumps, initiating the compression stroke from left to right. Due to the initial low compression pressure the unloading valve 84 will move the cut-off section 84*a* to the position, as shown in FIG. 1, activating the gear pump 65. Due to the basic characteristics of the compression cycle the gear pump 65 is substantially larger than the gear pump 66. This size differential results in the minimum time of the compression cycle, since large initial displacement of the compressor piston correspond to a comparatively small increase in the compression pressure. The relief valve 93 is made responsive to the pressure in the pressure vessel 46, in a manner as will be described in detail when referring to FIG. 5 and limits the discharge pressure spike on compressor piston reversal to a level, higher by a constant pressure differential, than the discharge pressure of the gas fuel compressor 10. Upon reaching the maximum rated pressure in the pressure vessel 46, the pressure switch 96, in a well known manner, will trip through the mechanism 101 the switch 99 effectively stopping the electric motor 67**.

Referring now to FIG. 2 the variable displacement piston type pump, generally designated as 103, with its control section, generally designated as 104, is interposed between the reservoir 105 and a single stage gas fuel compressor, generally designated as 106, the connection of the gas fuel compressor to the main gas line 33 and to the pressure vessel 46, together with the configuration of the four way valve 49 and all of the other system control components are identical to those shown and described, when referring to FIG. 1. In FIG. 2 the single stage gas compressor 106 is used instead of two stage gas compressor 10 of FIG. 1, in order to better demonstrate the principle of the invention. The variable displacement piston type pump 103, well known in the art, is driven by the motor 67, provided with the flywheel 68 and transfers, per each revolution, a quantity of oil from low pressure port 112 to high pressure port 113, which is connected through discharge line 116 with the four way valve 49. The quantity of oil transferred between ports 112 and 113 and therefore the quantity of flow of oil, per unit time, from the variable displacement pump 103, can be regulated from a maximum value to zero by the angle of inclination of surface 110 of swash plate 111. The angle of inclination of swash plate 111 is established by the position of the first actuating piston 117 and the second actuating piston 118, which are controlled by the control section 104. As previously described, when referring to FIG. 1, in a gas compressor, in order to utilize constant power input the velocity of the compressing piston must vary inversely in a nonlinear fashion, with the compression pressure. Therefore, to maintain a constant horsepower input into the compressor and therefore to obtain maximum compressed gas output per unit time out of the compressor, high piston velocity, required during the initial stages of compression, must be gradually reduced, as the compression cycle progresses. The control 104, of the variable displacement pump 103, automatically maintains the variable displacement pump 103 at its maximum flow output, until its discharge pressure will reach a level, at which it will bring the motor 67 to its full rated horsepower output. From this point on the control section 104, with rising system pressure, will automatically adjust flow out of the pump, to maintain constant rated horsepower output of the motor 67. After the end of the stroke of the compressor piston is reached the control section 104 will automatically bring the pump 103 into zero displacement position at a pressure, higher by a constant pressure differential, than that equivalent to pressure in the pressure vessel 46. The variable displacement pump 103, controlled in such a way by the control section 104, will accomplish the compression stroke of the compressor 106 in a minimum of time at maximum efficiency with the minimum horsepower rating of the motor 67. These specific control characteristics of the control section 104, are obtained in the following way. Assume that the compressor piston assembly was moved a short distance to the right, from the position as shown in FIG. 2, just starting the compression stroke. Due to low compression pressure the variable pump 103 will stay in its maximum displacement position and move the compressor piston assembly at maximum velocity. At this maximum velocity the compressor piston assembly will advance, increasing the compression pressure, while proportionally the discharge pressure of the pump is being increased to a point, at which the motor 67 will develop its rated horsepower. Let us call this critical pressure Px. Below Px pressure level the swash plate 111, of the variable pump 103, is maintained at its maximum angular inclination by the biasing force of the spring 123, acting on the swash plate 111 through the first actuating piston 117. At Px pressure level the force developed by on the cross-sectional area of the second control piston 130 by the discharge pressure will balance the preloads of the springs 134 and 123. An increase in the discharge pressure over Px pressure level and corresponding force developed on the second control piston 130 will gradually move the second actuating piston 118 from right to left, revolving the swash plate 111 in a clockwise direction, reducing its angle of inclination and there proportionally reducing the output of the variable pump 103. This reduction in output flow will be linear in respect to rising pressure, until the stop 133 will engage the housing 121, at which point the second control piston 130 will become inactive. Any further increase in the discharge pressure, conducted by passage 145 to the chamber 129, will react on the cross-sectional area of the first control piston 128, moving it from right to left against the biasing force of the spring 123, further reducing, through the second actuating piston 118 and the swash plate 111, the displacement of the variable pump 103. The pilot valve spool 138 at one end is subjected to the force developed by the pump discharge pressure, acting on its cross-sectional area and at the other end is subjected to the force developed on cross-sectional area of the third control piston 149, by the pressure existing in space 150, together with the biasing force of the spring 148. Space 150 is connected by lines **61*a* and 61 and the translating device 59 to the discharge pressure at the outlet of the compressor 106. Therefore during the compression stroke the pilot valve spool 138 will be maintained in a position, fully displaced to the right, with annular space 143 and control space 127 connected by annular space 141 and passage 142 with space 126 and therefore with the system reservoir 105. With the compressor piston stopped at the end of its compression stroke the pump discharge pressure will become higher than the gas discharge pressure in space 150 and the pilot valve spool 138 will move from right to left, past its modulating position as shown in FIG. 2, connecting annular space 143 and control space 127 with high pressure oil at pump discharge pressure. The second actuating piston 118 will rotate the swash plate 111 into its zero flow position. The pilot valve spool 138 will move back into its modulating position, as shown in FIG. 2, controlling the displacement of the variable pump 103 to maintain its discharge pressure at a level, higher by a constant pressure differential, than the gas discharge pressure in space 150, this constant pressure differential being equal to the biasing force of the spring 148 divided by the cross-sectional area of the pilot valve spool 138. The pressure spike, generated by stopping of the compressor piston at the end of its discharge stroke is further reduced by the relief valve 93, pressure setting of which is dictated by the compressor discharge pressure, the operation of which will be described when referring to FIG. 5**.

Referring now to FIG. 3, the gas compressor assembly, generally designated as 10, which can be used in power and control circuits of FIGS. 1 and 2, is shown in more detail. The piston assembly is shown in its extreme position to the left with the shock absorbers 184 and 172 engaging surfaces of the housing 203. In this position of the compressor piston assembly minimum clearance volume, filled with compressed gas, is left at the end of the compression stroke, in a well known manner contributing to the high volumetric efficiency of the compressor. If adiabatic compression temperatures are not too high, shock absorbers 184, 172 171 and 185 can be made from elastomer type material. At higher operating temperatures asbestos filled sound deadening type materials can be used. The diameter of the piston 22, of the hydraulic power stage 14, is so selected that the hydraulic pressure, required to drive the compressor piston assembly, is always higher than the maximum gas compression pressure in the high pressure compression chambers 18 and 20. This feature is very important for the following reasons. Assume that the compressor piston assembly is moved from right to left with second power chamber 24 being subjected to pressure developed by the pump 200 and the high pressure compression chamber 18 is subjected to the compressed gas pressure. The hydraulic oil under pressure is conducted from the second power chamber 24 through passage 189 in the piston 22 to space 187, which communicates with passage 190 to bearing 182, positioned between sealing rings 178 and 179. Therefore, during the compression stroke the hydraulic oil in the bearing 182, on the right side of the sealing ring 178, will be always at higher pressure than the compressed gas pressure on the left side of the sealing ring 178. Since the leakage of the fluid can only take place from higher to lower pressure zone, the hydraulic oil will leak past the sealing ring 178 into the high pressure compression chamber 18. Since the leakage of the fluid across a sealing ring is proportional to the viscosity of the fluid and the pressure differential and since the viscosity of average hydraulic oil is greater than viscosity of gas in the order of 5000 to 1, only a very small oil leakage will take place across the sealing ring, with no gas leakage taking place, thus contributing to the very high volumetric efficiency of the compressor. The leakage of the sealing oil into the compression chamber is still further reduced, since the pressure differential across the sealing ring is comparatively small, the oil pressure proportionally rising with the compression pressure. With first power chamber 23 subjected to hydraulic pressure the piston assembly will move from left to right, with the gas being compressed in the compression chamber 20. High pressure sealing oil will be conducted from the first power chamber 23 through passage 191, space 188 and passage 192 to bearing 183 where, in a manner as previously described, it will effectively seal gas contained within the compression chamber 20. The small quantity of hydraulic oil leaking into high pressure chambers may be separated from the compressed gas in the oil separation stage 43, which will be described in detail when referring to FIG. 11.

Referring now to FIG. 4, elongated low pressure stage piston 208 is provided with groove 209, which is connected through port 210 with a pressure translating device 59, which in turn is connected to the gas intercooler 36, maintained at an intermediate gas pressure. The translating device 59, which will be described in detail when referring to FIG. 6, provides groove 209 with hydraulic oil at a pressure exactly the same as the gas pressure in the intercooler 36. Therefore during the compression cycle in the first stage of the compressor hydraulic oil leakage past sealing rings 173 and 174 will take place to gas compression chambers, preventing an excessive gas leakage and providing high volumetric efficiency of the first gas compression stage.

Referring now to FIG. 5, the control valve 211 with the shuttle valve 240, which may be an integral part of it, is interposed between the schematically shown gas fuel compressor 10 and the system pump 200, which may be of two stage fixed displacement type of FIG. 1, or of a variable displacement type of FIG. 2. The gas fuel compressor 10 is hydraulically driven, the piston assembly being reciprocated by the hydraulic power stage 14, consisting of the piston 22 and first and second power chamber 23 and 24. The hydraulic power stage 14 is double acting, one of the power chambers 23 or 24 always being subjected to pressure oil from the pump 200, while the other is connected to the system reservoir 105. The pump pressure connection and the exhaust reservoir connection is sequentially changed in respect to the power chambers 23 and 24 by the control valve 211, providing a continuous reciprocating motion to the piston assembly of the compressor 10. This reciprocating motion is so controlled that the switching of the polarity of the hydraulic power stage 14 takes place exactly at the end of each compression stroke, providing a gas fuel compressor with a minimum clearance volume, in which gas reexpansion can take place therefore assuring a high volumetric efficiency.

With the position of the control spool 213, of the control valve 211, as shown in FIG. 5, the compressor piston assembly is in a position corresponding to the beginning of the compression stroke and moving from left to right, with the control valve 211 connecting the pump 200 with the first power chamber 23, while the second power chamber 24 is connected to the system reservoir 105. The shuttle pool 242 of the shuttle valve 240 is displaced all the way to the left, connecting the first chamber 219 of the control valve 211 with the pressurized oil from the pump 200, while also connecting the second chamber 220 with the system reservoir. Therefore, under those conditions, the control spool 213 of the control valve 211 is forcibly maintained, in the position as shown in FIG. 5, by force developed on its cross-sectional area by the pressure differential between the pump pressure and reservoir pressure. When moving the shuttle spool 242, of the shuttle valve 240, all the way from left to right the second chamber 220 is automatically connected to pressure oil, while the first chamber 219 is connected to system reservoir and the control spool 213 of the control valve 211 is moved all the way from right to left, connecting the second power chamber 24, of the hydraulic power stage 14, with the system pump 200, while also connecting the first power chamber 23 with the system reservoir 105, causing change in direction of motion of the compressor piston assembly.

Assume that with the system connected as shown in FIG. 5, the compressor piston assembly will move all the way to the right, with the volume of the second compression chamber 17 and the volume of the high pressure compression chamber 20 becoming zero and the compressor piston assembly stopped. The discharge pressure of the pump 200 will increase to a level, at which it will open the relief vave 93. The area of seat 273 is made approximately the same as the cross-sectional area of the stem 275, which is subjected, through the action of the translating device 59, to a hydraulic pressure, equal to the gas pressure in the pressure vessel 46. The poppet 271 of the relief valve 93 is also subjected to the biasing force of the spring 272. Therefore the relief valve 93 will always limit the discharge pressure of the pump 200 to a pressure, higher by a constant pressure differential, than the gas pressure in the pressure vessel 59, this constant pressure differential being equal to the quotient of the preload of the spring 272 and the area of seat 273, or the cross-sectional area of the stem 275. The signal generating poppets 228 and 235 operate on the same principle as the relief valve 93, but the preloads of springs 229 and 236 are so selected that the signal generating poppets will open with a constant pressure differential smaller than that required by the relief valve 93. The increase in discharge pressure of the pump 200, due to stopping of the compressor piston, will open the signal generating poppet 228, while the signal generating poppet 235 will remain closed. The outlet chamber 227 will become pressurized, the pump discharge pressure being transmitted by line 255 to the chamber 247 of the shuttle valve 240. Since the chamber 248 through line 265, the outlet chamber 234 and orifice 233 is connected to system reservoir, the shuttle spool 242 will move very fast all the way from left to right, resulting, in a manner as previously described, in full displacement to the left of the control spool 213, of the control valve 211, which will change the polarity of the hydraulic power stage 14 and initiate a compression stroke of the compressor piston assembly from right to left. Once the end of the compression stroke is reached and the compressor piston assembly stopped, the resulting pump discharge pressure, higher than the gas pressure in the pressure vessel 46, will activate, in a manner as previously described, the signal generating poppet 235 and will move the shuttle spool 242 all the way to the left, to the position as shown in FIG. 5, moving the control spool 213, of the control valve 211, all the way to the right, to the position as shown in FIG. 5, changing the polarity of the hydraulic power stage 14 and initiating the compression stroke of the compressor piston assembly from left to right. Therefore on completion of each compression stroke, with compressor piston assembly stopped, the resulting increase of the pump discharge pressure over the pressure of the gas, contained in the pressure vessel 46, will automatically change the polarity of the hydraulic power stage 14, initiating a new compression stroke in the opposite direction. Since the stroke reversal takes place at the end of each stroke, with minimum volume of gas contained in each compression chamber, high volumetric efficiency of the compressor is obtained. Also since the magnitude of the pressure spike, which triggers the reversal of the compressor piston, is a function of the gas pressure in the pressure vessel 46 and varies with this gas pressure, the mechanical efficiency of the system becomes very high. A friction device, well known in the art, may be added to the shuttle spool 242 to maintain it in each working position and to prevent any drift of the spool during compression stroke.

Referring now to FIG. 6 a translating device, generally designated as 59 and shown schematically in circuits of FIGS. 1, 2 and 5, is shown in detail. The translating device 59 is interposed between the gas discharge circuit and the hydraulic power circuit and supplies hydraulic oil, at a pressure, equal to the gas discharge pressure, to provide the control force input to poppet 271, of the relief valve 93 and to the signal generator poppets 228 and 235, of the control valve 211, see FIG. 5. The use of hydraulic oil instead of gas to provide control force input to poppets 271, 228 and 235 is very important, since it reduces the friction forces of those control components, eliminates large leakage loss of the compressed gas and prevents the gas fuel from entering the oil circuit. The gas to oil pressure translating device comprises the housing 276, into which the diaphragm support 284 and the cover 278, with its insert 280, are assembled by suitably crimping rim 277. The cover 278 and the diaphragm support 284 retain, in sealing engagement, the bead 283 of free floating diaphragm 284, which defines spaces 285 and 286. The spool 287, provided with passages 291, 292 and 293 and guided in bore 290, is secured to the diaphragm 284 by washers 288 and 289. Space 285, filled with compressed gas fuel, is connected through porous insert 280, annular space 281, port 282 and line 41 to the pressure vessel 46 not shown. Space 286, filled with pressurized hydraulic oil, is connected through passage 298, port 299 and line 61 to the specific controls of the power circuit and is also selectively connected through passages 291, 292 and 293, annular space 295, port 297, check valve **297*a* and line 59*a* with the discharge of the system pump, not shown. The displacement of poppets 271, 228 and 235, see FIG. 5, will change the position of the free floating diaphragm 284, which in a well known manner ensures that the pressure in spaces 285 and 286 remains the same. Leakage of pressure oil through clearances of stems of poppets 271, 228 and 235 also alters the position of the free floating diaphragm 284, with the diaphragm tending to drift downward, moving the spool 297 and the passage 293 past the control surface 310, effectively connecting space 286 with annular space 295. As described in detail, when referring to FIG. 5, the pump discharge pressure exceeds gas and oil pressure in spaces 285 and 286 during each reversal of direction of the compressor piston. The resulting pressure spike, transmitted through line 59*a*, opens the check valve 297*a*, oil at higher pressure flowing through port 297, annular space 295 and passages 293, 292 and 291 to space 286, lifting the free floating diaphragm 284 and spool 287, the control surface 296 gradually isolating passage 293 from annular space 295, effectively isolating the system pump from space 286. With lowering of the system pressure, during the initial stages of the compression cycle, the check valve 297*a* seats, effectively isolating the system pump from annular space 295. Therefore any oil used from space 286 by the system controls is automatically replenished from the pump circuit during pressure spikes, maintaining the free floating diaphragm 284 approximately in its mean position. Once the gas pressure will reach its maximum value and the pump is stopped by the pressure switch 96, see FIGS. 1 and 2, due to the leakage of the system controls the free floating diaphragm 284 will drift slowly downward, until the washer 289 will engage the diaphragm support 279 and the diaphragm itself will rest on the surface of the porous diaphragm support 279, the porous material permitting flow of oil, but preventing extrusion of diaphragm elastomer material. After a period of time the pressure vessel 46 is disconnected from the compressor and the space 285 is subjected to atmospheric pressure. Space 294 may be provided with a spring, which with space 285 at atmospheric pressure would lift the spool and the diaphragm assembly to its normal free floating position, the oil being supplied from the hydraulic circuit through check valve 297*a*, until control surface 296 would isolate passage 293. With the diaphragm 284 resting against the diaphragm support 279, once the translating device is connected to the empty pressure vessel 46, with the system pump started up, space 286 will be immediately replenished with oil at pressure equal to the minimum pressure setting of the relief valve 93. Use of spring in space 294 would be justified under conditions of connecting the partially filled pressure vessel to the translating device 59** and then starting the system pump.

Referring now to FIG. 7, a signal generator, generally designated as 56 or 55, see FIGS. 1 and 2, is shown in a simplified form, with its own source of hydraulic fluid. The poppet 302 is subjected to pressure in control space 310, acting on the cross-sectional area of the poppet stem, subjected to pressure in port 305, acting on the area enclosed by seat 304 and is also subjected to the biasing force of the spring 303. Therefore the poppet 302 will connect port 305 with space 306, once the pressure in port 305 will exceed the pressure in control space 310 by a certain constant pressure differential, equal to the quotient of the preload of the spring 303 and area enclosed by seat 304, or cross-sectional area of the poppet stem, those two areas being selected approximately equal. Port 305 is connected to the system pump, space 310 is connected to space 312, which is filled with oil subjected to gas pressure and space 306 is connected to system controls and through orifice 308 to the system reservoir. The signal generator 55 or 56 sends a pressure signal to the system controls, once the pump pressure exceeds, by a certain constant pressure differential, the compressed gas fuel pressure.

Referring now to FIG. 8 a discharge check valve with zero clearance volume is shown. When subjected to pressure differential the poppet 315 will lift, permitting gas flow to space 317. The sealing device 323 would only be used if the gas temperature, due to heat of adiabatic type compression, is low enough to permit use of an elastomer type material.

Referring now to FIG. 9 a suction check valve with zero clearance volume is shown. When subjected to pressure differential the poppet 336 will move downward permitting flow of gas from the chamber 330 to the compression chamber of the gas compressor.

Referring now to FIG. 10 a different type of suction check valve with zero clearance volume is shown. When subjected to pressure differential elastomer flexing member 347 will lift from the porous metal flange section 344, permitting flow of gas from space 342 to the compression chamber. This type of suction check valve can only be used when compression cycle temperatures are low enough to permit the use of elastomer type material.

Referring now to FIG. 11, an oil and water separation stage, generally designated as 43, schematically illustrated in FIG. 1, is shown connected into the hydraulic power circuit by a cut-off valve, generally designated as 352. The water and oil separation stage 43 acts also as a heat exchanger, cooling the the compressed gas on its way from the compressor to the pressure vessel 46. A small quantity of oil leaks past the seals, separating compression chambers, see FIG. 3, and is delivered into the compressor discharge. Gas like methane will contain water vapor, the amount of which may vary widely. This water vapor, after compression of the gas to high pressure levels, in a well known manner, will be condensed in the discharge lines, once the temperature of the compressed gas will be lowered. Since it is undesirable to condense large amounts of oil and water in the pressure vessel 46, the compressed gas is cooled and filtered in the oil and water separation stage 43. The compressed gas is cooled in the labyrinth chamber 357, the moisture condensing on the labyrinth fins and collecting in the flow channel 361. The remaining condensed water and oil in the form of very small droplets is passed through the first porous filter element, which is usually made out of felt-like material, is filtered out and is deposited in the filter chamber 358. The gas also passes through the second porous filter element and any remaining water and oil is returned, once the compression cycle is stopped, from the outlet chamber 359 through port 365 to the filter chamber 358. Once the gas discharge pressure reaches a certain maximum predetermined level the pressure switch 96, of FIGS. 1 and 2, will stop the compressor. Line 42 is usually provided with a spring loaded check valve, which prevents the return flow of the gas from the pressure vessel 46. Once the compressor is stopped the gas pressure in the filter chamber 358 will drop below a level, equivalent to preload of the spring 370, of the cut-off valve 352 and in the absence of the control signal 372 the cut-off valve 352 will connect the filter chamber 358 with the system reservoir, to which the oil and water collected in the filter chamber 358, will drain. This water and oil may be drained off to an intermediate chamber provided with a heater coil, where the condensed water would be boiled off. The cut-off valve in the presence of gas pressure in the filter chamber and in the presence of control signal 372 always remains closed. Control signal 372 is automatically interrupted once the compressor is stopped by the pressure switch 96.

Referring now to FIG. 12 a hydraulically driven three stage double acting compressor, generally designated as 374 is shown. The compressor 374 comprises first gas compression stage 375 connected with check valves to the main gas line 33 and to a first intercooler 376, second gas compression stage 377 connected with check valves with the first intercooler 376 and a second intercooler 378, third gas compression stage 379 and 380 connected with check valves with the second intercooler 378 and through the water and oil separating stage 43 also connected to the pressure vessel 46 and a hydraulic power stage 381 connected through control valve 49 to the system pump 200. Since the compressor 374 has three compression stages the compression ratio per stage is reduced, resulting in much lower gas discharge temperatures and a higher compression efficiency. The hydraulic power stage 381 with its piston 382 is provided with two damping pistons 383 and 384, cooperating with damping cylinders 385 and 386. Assume that piston assembly of compressor 374 is moving from right to left. The damping piston 383 is provided with approximately the same diameter as the damping cylinder 385, with only minimum working clearance. The damping piston 383 upon entering the damping cylinder 385 will generate high resistance to motion, in turn generating a pressure spike in pump discharge, which in turn, in a manner as described when referring to FIG. 5, will reverse the direction of stroke of compressor piston assembly. Therefore, by selecting length of the damping pistons 383 and 384, the length of the compression stroke can be established, with no metal to metal contact taking place between the compressor housing and the compressor piston assembly, when the piston assembly is stopped and its direction of motion reversed.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. A double acting compressor drive system comprising a free floating piston assembly having at least one gas compression piston means provided with compressed gas outlet means, and hydraulic drive means having first and second chambers and hydraulic piston means operable to transmit a reciprocating motion to said gas compression piston means, a pump having a discharge outlet, exhaust means, control valve means operable to sequentially connect said first and said second chamber with said discharge outlet and said exhaust means at the end of each compression stroke, and relief valve means interposed between said pump and said exhaust means having means operable to maintain a relatively constant pressure differential between pressure in said discharge outlet and pressure in said compressed gas outlet means once said pressure in said discharge outlet exceeds pressure in said compressed gas outlet means by the amount of said relatively constant pressure differential.

2. A double acting compressor drive system as set forth in claim 1 wherein said relief valve means has first force generating means responsive to pressure in said discharge outlet, second force generating means responsive to pressure in said compressed gas outlet means and opposing said first force generating means, and spring biasing means opposing said first force generating means.

3. A double acting compressor drive system as set forth in claim 1 wherein said control valve means has direction control valve means operable by shuttle valve means said shuttle valve means having means responsive to pressure peaks of said relief valve means.

4. A double acting compressor drive system as set forth in claim 1 wherein said control valve means has pressure signal generating means responsive to pressure in said discharge outlet and to pressure in said compressed gas outlet means and direction control valve means responsive to pressure signal generated by said pressure signal generating means.

5. A double acting compressor drive system as set forth in claim 4 wherein said pressure signal generating means has first force generating means responsive to pressure in said discharge outlet, second force generating means responsive to pressure in said compressed gas outlet means and opposing said first force generating means and spring biasing means opposing said first force generating means.

6. A double acting compressor drive system as set forth in claim 4 wherein said pressure signal generating means are responsive to a relatively constant pressure differential between pressure in said discharge outlet and to pressure in said compressed gas outlet means said pressure differential being smaller than pressure differential of said relief valve means.

7. A double acting compressor drive system as set forth in claim 4 wherein said pressure signal generating means communicate with said exhaust means through orifice means.

8. A double acting compressor drive system as set forth in claim 4 wherein said control valve means has shuttle valve means.

9. A double acting compressor drive system as set forth in claim 1 wherein said control valve means has direction control valve means operable by shuttle valve means said shuttle valve means being responsive to pressure signal generated by signal generating means.

10. A double acting compressor drive system as set forth in claim 9 wherein said pressure signal generating means have means responsive to higher pressure transients at the point of stopping of said free floating piston assembly.

* * * * *